US007355123B2

(12) United States Patent
Kimura et al.

(10) Patent No.: US 7,355,123 B2
(45) **Date of Patent: *Apr. 8, 2008**

(54) FOAM COAXIAL CABLE AND METHOD OF MANUFACTURING THE SAME

(75) Inventors: Hiroyuki Kimura, Koga (JP); Mitsuo Iwasaki, Koga (JP); Shigeru Murayama, Tokyo (JP); Shigeru Matsumura, Tokyo (JP)

(73) Assignees: Hirakawa Hewtech Corporation, Tokyo (JP); Advantest Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/557,715

(22) PCT Filed: May 19, 2004

(86) PCT No.: PCT/JP2004/007117

§ 371 (c)(1),
(2), (4) Date: Jan. 19, 2006

(87) PCT Pub. No.: WO2004/112059

PCT Pub. Date: Dec. 23, 2004

(65) Prior Publication Data

US 2006/0254792 A1 Nov. 16, 2006

(30) Foreign Application Priority Data

May 22, 2003 (JP) ..... 2003-145341

(51) Int. Cl.
*H01B 7/00* (2006.01)

(52) U.S. Cl. ..... 174/102 R; 174/110 R; 174/110 F

(58) Field of Classification Search ..... 174/102 R, 174/108, 110 R, 110 F, 28, 36; 333/243
See application file for complete search history.

(56) References Cited

U.S. PATENT DOCUMENTS

| | | | | |
|---|---|---|---|---|
| 4,866,212 | A * | 9/1989 | Ingram | 174/28 |
| 5,210,377 | A * | 5/1993 | Kennedy et al. | 174/107 |
| 5,293,001 | A * | 3/1994 | Gebs | 174/36 |
| 5,429,869 | A * | 7/1995 | McGregor et al. | 428/364 |
| 5,554,236 | A * | 9/1996 | Singles et al. | 156/52 |
| 5,717,981 | A * | 2/1998 | Yamanaka | 399/101 |
| 5,750,931 | A * | 5/1998 | McGregor et al. | 174/110 PM |
| 6,337,443 | B1 * | 1/2002 | Dlugas et al. | 174/120 R |
| 6,963,032 | B2 * | 11/2005 | Yamaguchi et al. | 174/102 R |
| 2003/0011958 | A1 * | 1/2003 | Kolmschlag et al. | 361/302 |
| 2003/0201116 | A1 * | 10/2003 | Carlson et al. | 174/102 R |
| 2004/0074654 | A1 * | 4/2004 | Springer et al. | 174/28 |

(Continued)

FOREIGN PATENT DOCUMENTS

JP 59-065422 5/1984

(Continued)

*Primary Examiner*—William H. Mayo, III
(74) *Attorney, Agent, or Firm*—McGinn IP Law Group, PLLC

(57) ABSTRACT

A foam coaxial cable, including an inner conductor, a foam insulating layer formed on the outer periphery of the inner conductor, an outer conductor formed on the outer periphery of the foam insulating layer, and an outer cover formed on the outer periphery of the outer conductor. A skin layer having a generally complete round outline is formed on the outer periphery of the foam insulating layer.

20 Claims, 4 Drawing Sheets

U.S. PATENT DOCUMENTS

2005/0115738 A1* 6/2005 Yamaguchi et al. .... 174/102 R

FOREIGN PATENT DOCUMENTS

JP 03-219505 A * 3/1991
JP 3-040034 4/1991
JP 11-260161 9/1999
JP 2000-048653 2/2000

* cited by examiner

FOAM COAXIAL CABLE AND METHOD OF MANUFACTURING THE SAME

TECHNICAL FIELD

The present invention relates to a foam coaxial cable wherein an insulating member on the outer periphery of an inner conductor is formed from a porous tape member, and an outer conductor is formed by a braided shield member; the foam coaxial cable, for example, which is applied to information communication equipment and an examination/inspection apparatus of semiconductor devices applied to the equipment wherein accuracy of characteristic impedance values between the inner conductor and the outer conductor wherein an insulating member is interposed between them is made to be ±1 Ω. Furthermore, the present invention relates to a method of manufacturing the foam coaxial cable.

BACKGROUND TECHNOLOGY

With the progress of advanced information society in recent years, there are strong requests for speeding up in a transmission rate and improving accuracy in transmission of information communication equipment and an examination/inspection apparatus of semiconductor devices applied to the equipment. Under the circumstances, speeding up in a transmission rate and improving accuracy are also requested in a coaxial cable and a coaxial cord.

When typical electric characteristics required for a coaxial cable will be mentioned, they are as follows.

$$\text{Propagation delay time}(Td)=\sqrt{\epsilon}/0.3(\text{ns/m})$$

$$\text{Relative transmission rate}(V)=100/\sqrt{\epsilon}(\%)$$

$$\text{Characteristic impedance}(Zo)=60/\sqrt{\epsilon}\cdot LnD/d(\Omega)$$

$$\text{Electrostatic capacity}(C)=55.63\epsilon/LnD/d(\text{pF/m})$$

where $\epsilon$: specific inductive capacity of an insulating member, D: outer diameter of the insulating member (inner diameter of an outer conductor), and d: conductor outer diameter (outer diameter of an inner conductor).

From the above description, it is found that transmission characteristics of a coaxial cable are influenced by the specific inductive capacity and the outer diameter of an insulating member, and the outer diameter of an inner conductor. It is understood that concerning the specific inductive capacity of an insulating member, the smaller value thereof result in the better transmission characteristics, and that concerning outer diameters of an inner conductor and an insulating member, its transmission characteristics are remarkably influenced by a ratio and dispersion. Particularly, as to characteristic impedance and electrostatic capacity, it is understood that ideal is in that a specific inductive capacity of an insulating member is small and the dispersion thereof is less, and in that dispersion of outer diameters (an inner diameter of shield layer) and the like of an inner conductor and an insulating layer and the outlines thereof are formed so as to have a generally more complete round sectional cylindrical shape.

In this respect, however, a conventional coaxial cable involves the problems described in the following paragraphs (1) to (3).

(1) An inner conductor applied to the coaxial cable is a silver-plated soft copper wire of AWG 20 to 30, or a twisted conductor obtained by twisting them. However, a diameter tolerance of a silver-plated soft copper wire is ±3/1000 mm, while when a twisted conductor is obtained by, for example, twisting seven strands, an outer diameter tolerance of the resulting twisted conductor becomes ±3×3/1000 mm. Due to the results mentioned above, when a preparation of a cable is intended within ±tolerance of the outer diameter, it becomes a remarkable variation factor in the above-mentioned characteristic impedance, electrostatic capacity and the like. This result becomes the higher with appearance in the thinner inner conductor.

(2) Concerning a foam insulating member applied to the coaxial cable, it is intended at present to reduce a transmission time and attenuation by making a porosity (ratio of forming) to be 60% or more to increase air gaps, whereby a specific inductive capacity ($\epsilon$) is made to be 1.4 or less in order that a propagation delay time of the cable is made to be smaller as less as possible thereby to expedite a transmission rate. A member prepared by winding a porous tape member made of polytetrafluoroethylene (PTFE) (for example, those described in patent literary documents 1 and 2) on the outer periphery of an inner conductor, and calcining the inner conductor thus wound at the time or after winding the porous tape member is used as an insulator material having a porosity of 60% or more and a specific inductive capacity of 1.4 or less, and there is a polyethylene tape member having a weight average molecular weight of five million or more (for example, that described in patent literary document 3) as the other porous member than that mentioned above.

Patent literary document 1: Patent Publication No. 42-13560

Patent literary document 2: Patent Publication No. 51-18991

Patent literary document 3: Patent Application Laid-Open No. 2001-297633

However, these insulating layers exhibit remarkable dispersion in their thicknesses and porosities in view of properties of a porous tape member, so that improvement is strongly demanded in stability of transmission characteristics of a coaxial cable. Particularly, in a coaxial cable wherein an inner conductor size is made to be a thin diameter conductor of AWG 24 or more and a characteristic impedance value is made to be 50 Ω, dispersion in thickness, outer diameter, porosity, calcination and the like become remarkable drawbacks in view of eliminating dispersion of transmission characteristics for intending to realize stability.

Moreover, since the insulating layer is constituted by winding a porous tape member on the outer periphery of an inner conductor, irregular outline due to gap portions and overlapping of the tape appears in the overlapped portions of the tape member on the outer periphery of the conductor, whereby dispersion in specific inductive capacity and its outer diameter increases remarkably.

Furthermore, since the insulating layer is constituted by winding of a porous tape member having a very low mechanical strength, it is required to significantly decrease tension of the tape member as less as possible in order to eliminate elongation and breaking of the tape member itself at the time of winding thereof and also elongation and disconnection of a superfine inner conductor. Because of the situation, an irregular outline and dispersion in its outer diameter become more remarkable, besides a degree of adhesion of the tape member is very weak with respect to an inner conductor, so that dispersion in its specific inductive capacity and its outer diameter expands further.

In addition, since a specific inductive capacity is reduced for the primary objective of decreasing a propagation delay time of a cable as less as possible to increase a transmission rate in the insulating layer, there still remains such drawback in mechanical strength that the coaxial cable is difficult to assure a structural dimension as a coaxial cable due to mechanical stress such as bending, torsion, pressing, sliding and the like which will be received by the coaxial cable. The most remarkable disadvantage is in that it is difficult to maintain the outer diameter of an insulating member in a predetermined outer diameter to eliminate its dispersion, and further to form the outline of the insulating member in a cylindrical shape.

(3) In such type of conventional coaxial cables as mentioned above, a member prepared by either winding a plastic tape member either surface of which contains a metallic layer such as a copper layer on the outer periphery of an insulating member, or including the plastic tape member lengthwise on the insulating member; a member constituted by a silver-plated soft copper wires having an outer diameter tolerance of ±3/1000 mm JIS standard or a braid member of the silver-plated soft copper wires braided with tin-plated soft copper wires; or a member in combination of the tape member and the braided member is used as an outer conductor participated remarkably in transmission characteristics of a coaxial cable.

However, in the member obtained by winding the tape member or including the tape member lengthwise, flexibility of the cable is insufficient, and thus, its outer conductor is easily broken by mechanical stresses such as flexure, and torsion which will be added to the cable, whereby functions as an outer conductor cannot be achieved. The braided member of silver-plated soft copper wires involves such problems that since slippage of silver is small, frictional force due to contact in the silver-plated soft copper wires with each other increases, so that movements in respective strands constituting the braided member disappear, whereby flexibility of the cable is lost, resulting in deformation of an insulating layer, and characteristic impedance values vary. Besides, it cannot decrease influences by mechanical stresses, and thus a life of the cable becomes shortened.

When the braid member of tin-plated soft copper wires is used under a high temperature (80° C. or higher), copper diffuses into a tin-plated layer, and production/growth of tin whiskers are accelerated due to diffusion stress. When the whiskers grow remarkably, they burst through an ultrathin insulating member, and as a result, there is case where the whiskers short-circuit with its inner conductor. Moreover, the above-described respective outer conductors are formed on the periphery of an insulating member which contains irregular outline and dispersion in its outer diameter as mentioned in the explanation of the insulating member in the paragraph (2) Accordingly, inner and outer parts of an outer conductor are irregular and dispersion in its outer diameter remains remarkably, so that a number of gaps are contained in between the outer conductor and the insulating layer, whereby a varying factor of specific inductive capacity still remains.

The present invention has been made in view of the above-described problems, and an object of the invention is to provide a foam coaxial cable which can speed up a transmission rate, improve accuracy in characteristic impedance values, make flexibility of a cable better, and assure a predetermined mechanical strength by decreasing mechanical stresses such as flexure, torsion, pressing, and sliding, even when such mechanical stresses are added to the cable, besides it can also reduce variations in characteristic impedance values.

Furthermore, another object of the present invention is to provide a method of manufacturing a foam coaxial cable which can intend to improve accuracy in characteristic impedance values between an inner conductor and an outer conductor, and stabilize a secondary shaping step by such a manner that a highly foamed insulating layer of the coaxial cable containing a foam insulating layer (a degree of foaming of 60% or more) to which a porous tape member is applied and the outer conductor are subjected to secondary shaping, whereby thicknesses and outer diameters of them are uniformized, and the outline of which is made to be a generally complete round shape.

DISCLOSURE OF THE INVENTION

In order to achieve the above-described object, the invention provides a foam coaxial cable composed of an inner conductor, a foam insulating layer formed on the outer periphery of the inner conductor, and an outer conductor formed on the outer periphery of the foam insulating layer, characterized by that a skin layer having a generally complete round outline is formed on the outer periphery of the foam insulating layer wherein the skin layer has preferably outer diameter accuracy of ±0.02 mm, and accuracy of characteristic impedance values between the inner conductor and the outer conductor in which the foam insulating layer and the skin layer are interposed between them is preferably ±1Ω.

Furthermore, in order to achieve the above-described object, the invention provides a foam coaxial cable composed of an inner conductor, a foam insulating layer formed on the outer periphery of the inner conductor, and an outer conductor formed on the outer periphery of the foam insulating layer, characterized by that the inner conductor has outer diameter accuracy of 4/1000 mm or less; the foam insulating layer is formed with winding a porous tape member, and it has a generally complete round outline and outer diameter accuracy of ±0.02 mm after forming the foam insulating layer; a skin layer having a generally complete round outline and outer diameter accuracy of ±0.02 mm is formed on the outer periphery of the foam insulating layer; and accuracy of characteristic impedance values between the inner conductor and the outer conductor in which the foam insulating layer and the skin layer are interposed between them is ±1Ω.

Moreover, in order to achieve the above-described object, the invention provides a method of manufacturing a foam coaxial cable involving an inner conductor, a foam insulating layer formed on the outer periphery of the inner conductor, and an outer conductor formed on the outer periphery of the foam insulating layer, characterized by including an insulative layer forming step for winding a porous tape member on the inner conductor supplied from a supply section to form the foam insulating layer; an insulating layer shaping step for inserting the foam insulating layer formed in the insulating layer forming step into shaping dies having a predetermined inner diameter to shape the foam insulating layer so as to have a predetermined outer diameter and a generally complete round outline; a skin layer forming step for forming a skin layer having a uniform thickness and a generally complete round shape on the outer periphery of the foam insulating member shaped in the insulating layer shaping step; an outer conductor forming step for forming the outer conductor on the outer periphery of the skin layer formed in the skin layer forming step; and an outer conductor shaping step for inserting the outer conductor formed in the outer conductor forming step into shaping dies having a predetermined inner diameter so as to have a predetermined outer diameter and a generally complete round outline.

Functions and advantageous effects of the invention described in the respective claims are as follows.

(1) In the inventions of claims 1, 2, and 4, since a porous tape member is wound once, and a skin layer is provided on the outer periphery thereof by extrusion molding, productivity of an insulating member is improved, outer diameter accuracy becomes better, and it becomes also stronger with respect to pressing.

(2) In the invention of claim 3, irregularities in an inner conductor and its outer diameter variations can be reduced for decreasing variations in characteristic impedance values.

(3) In the invention of claim 5, since a porous tape member is wound with no ply, variations in its outer diameter can decrease further, whereby productivity thereof is improved.

(4) In the invention of claim 6, when dispersion in a specific inductive capacity, a thickness, and an outer diameter of a porous tape member forming a foam insulating layer is reduced, variations in the specific inductive capacity and the outer diameter of the insulating layer can be reduced, and winding tension of the tape member can be kept in constant.

(5) In the inventions of claims 7 and 14, since a foam skin layer is provided, a specific inductive capacity of an insulating member does not increase, so that respective transmission characteristics do not increase.

(6) In the invention of claim 8, shaping accuracy in an outer diameter and an outline is improved.

(7) In the inventions of claims 9 and 16, productivity of an outer conductor is improved. Besides, the outer diameter of the outer conductor and shaping accuracy of the outline are improved.

(8) In the invention of claim 10, flexibility of the cable is improved. Further, no gap appears in the braid member, and the braid member comes to be in close contact with the insulating member, whereby the outer diameter of the outer conductor and shaping accuracy of the outline are improved.

(9) In the inventions of claims 11 and 12, when a mechanical stress is applied to a cable, respective strands of the braid member are movable. In addition, since slippage is improved in the braid member, flexibility of the cable is also improved, so that close contact with the insulating member is improved.

(10) In the invention of claim 13, diffusion of copper is prevented, whereby production and growth of whiskers are prevented, so that slippage of strands in the braid member is improved.

(11) In the invention of claim 14, close contact in the inner conductor, the foam insulating layer, and the skin layer with each other; the skin layer and the outer conductor with each other; and integration of them are improved; besides the cable is formed in a generally complete round shape, whereby its productivity and transmission characteristics are improved.

(12) In the invention of claim 15, the foam skin layer is in close contact with the foam insulating layer to be integrated, so that its mechanical strength is improved, whereby productivity is improved.

BEST MODE FOR EMBODYING THE INVENTION

In the following, examples according to the present invention will be described in detail by referring to the accompanying drawings.

Figure 1:
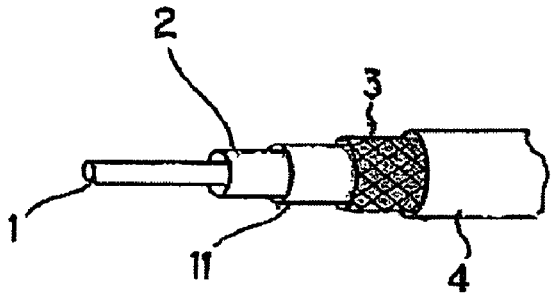
FIG. 1 shows an example of a foam coaxial cable according to the present invention.

FIG. 1 shows a constitution of a foam coaxial cable of example 1, 2, or 3 according to the present invention. As shown in FIG. 1, the foam coaxial cable of the present example is constituted by covering sequentially an inner conductor 1 containing a plurality of strands with a foam insulating layer 2, a skin layer made of a resin, an outer conductor 3 of braid member, and an outer cover 4.

Detailed respective constitutions of the foam coaxial cables of examples 1 to 3 according to the present invention are described in the following Table 1.

The inner conductor 1 is prepared by twisting silver-plated soft copper wire having an outer diameter of 0.16 mm seven times.

The foam insulating layer 2 is prepared by winding a porous tape member 21 being an insulating member of PTFE or the like having a porosity of 60% or more, for example, 5.1 mm tape width and 0.12 mm thickness in ½ ply at a winding angle of 80 degrees. In another example, no-ply winding of the porous tape member 21 may be applied wherein a tape having 0.24 mm thickness is used.

In the case when the foam insulating layer 2 is formed by winding-around of the porous tape member 21, gaps are produced inside and outside the porous tape member 21. In order to uniform such gaps, a thickness and an outer diameter of the foam insulating layer 2 obtained by the winding-around, and to make an outline of the foam insulating layer 2 to be generally complete round, the insulating layer 2 thus wound-around is inserted into shaping dies having an inner diameter of 0.95 to 0.94 mm, and a die length of 3.0 mm to implement secondary shaping. The manner for secondary shaping will be mentioned later.

The skin layer 11 provided on the outer periphery of the foam insulating layer 2 is made of either a solid layer or a foam layer of an olefin resin or a fluorine resin. In case of a solid layer, a finish outer diameter is 1.15 mm±0.02 mm, and which is formed by extrusion molding of PP, PE resin or FEP resin. In case of a foam layer, its thickness is made to be thinner as less as possible, a finish outer diameter is 1.15 mm±0.02 mm, and which is formed by extrusion molding of a PP, PE or FEP resin layer.

A total relative dielectric constant of an insulating layer composed of the foam insulating layer 2 and the skin layer 11 is decided dependent upon a porosity of the foam insulating layer 2 and a porosity of the skin layer 11. For this reason, when the skin layer 11 is made to be a solid layer, it is required to increase the porosity of the foam insulating layer 2. For instance, in case of forming the skin layer 11 by a solid layer of a FEP resin, when its relative dielectric constant is 2.1, a thickness is 0.09 mm, and a characteristic impedance value of a coaxial cable is made to be 50 Ω, a relative dielectric constant of a whole insulating layer composed of the foam insulating layer 2 and the skin layer 11 becomes 1.38 and a porosity of the whole insulating layer becomes 60%.

On one hand, for example, when the skin layer 11 is formed into a foam layer of a PE resin, it is required that a porosity is made to be 50% or less in such that the skin layer 11 itself is not adversely affected as less as possible by collapse, deformation and the like due to mechanical strengths such as bending, torsion, pressing, and flexure. Thus, when its thickness is 0.09 mm, and a characteristic impedance value of a coaxial cable is made to be 50 Ω, a relative dielectric constant of a whole insulating layer composed of the foam insulating layer 2 and the skin layer 11 becomes 1.45, and a porosity of the whole insulating layer becomes 55%.

Figure 6:
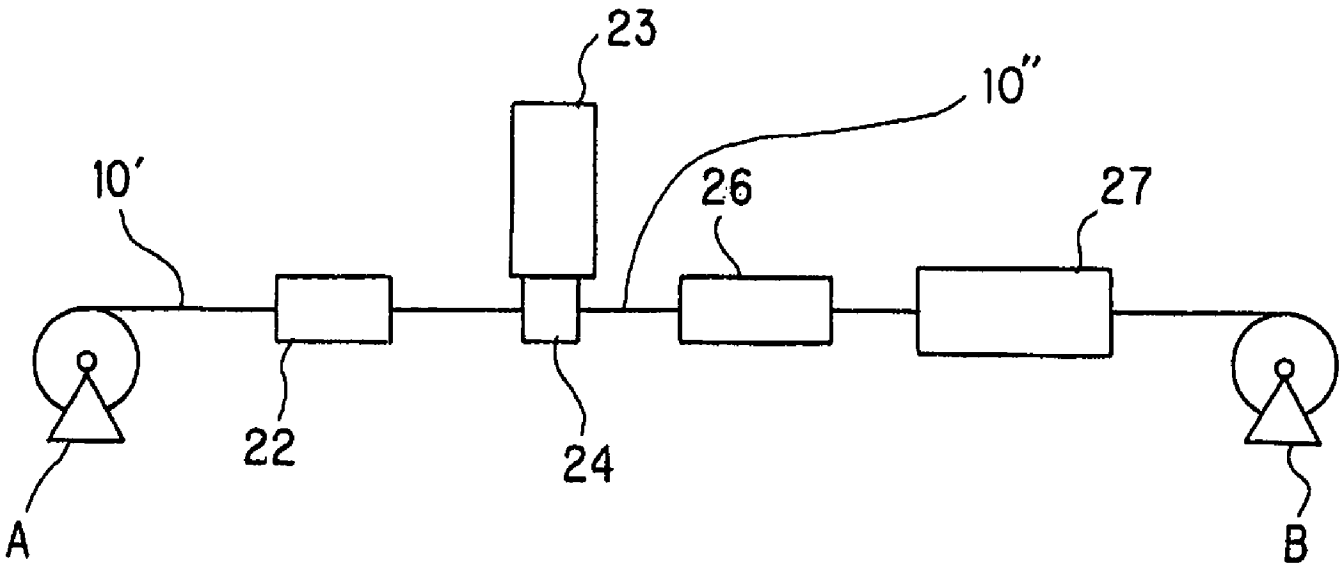
FIG. 6 is an explanatory view showing an example of a method of manufacturing a foam coaxial cable according to the present invention including a step for forming a skin layer 11 on the outer periphery of a foam insulating layer 2 through extrusion, and a step for shaping the skin layer thereafter.

After forming the skin layer 11, when a cable is inserted into shaping dies 26 as shown in FIG. 6, an outer diameter and an outline of the cable are shaped. In the case where the skin layer 11 is a solid layer, shaping of the outer diameter and the outline after forming the skin layer 11 is not required. However, when the skin layer 11 is formed in a foam layer, accuracy in its outer diameter due to foaming becomes unstable, so that shaping of the outer diameter and the outline becomes necessary.

The outer conductor 3 is formed by including a braid member or a conductive foil lengthwise, or winding a braid member or a conductive foil. If flexibility is not required for a coaxial cable, in other words, when the coaxial cable is applied to a stationary wiring which is not moved when once wired, or the like wiring, the coaxial cable may be formed by including a copper tape, or a conductive foil composed of a copper tape and a plastic tape or the like lengthwise; or winding a copper tape, or a conductive foil composed of a copper tape and a plastic tape or the like.

In the case when the outer conductor 3 is formed by including a braid member or a conductive foil lengthwise e (FIG. 2), a tensile strength of the braid member or the conductive foil is required so as to withstand tensile-force at the time when the braid member or the conductive foil is drawn by means of dies having a predetermined diameter. On one hand, when the outer conductor 3 is formed by winding a braid member or a conductor foil (FIG. 3), a tensile strength of the braid member or the conductive foil is required so as to withstand tensile-force at the time when the braid member or the conductive foil is wound. For instance, in the case where the outer conductor 3 is formed from a copper foil tape member, 0.04 mm thickness is required for obtaining the above-described tensile-force. In this respect, however, when the outer conductor 3 is formed from a composite tape member composed of a copper foil and a plastic tape member, a thickness of a copper foil may be thinner up to 0.01 mm while assuring the above-described tensile-force.

Figure 2:
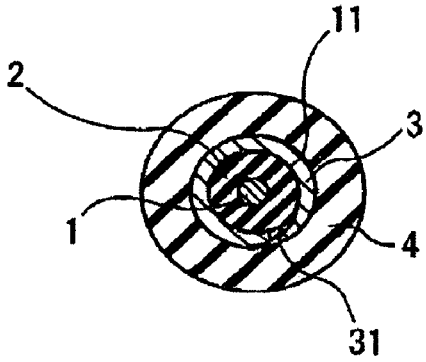
FIG. 2 is a sectional view showing an example of a foam coaxial cable according to the present invention wherein an outer conductor 3 is formed by including a conductive film lengthwise.
Figure 3:
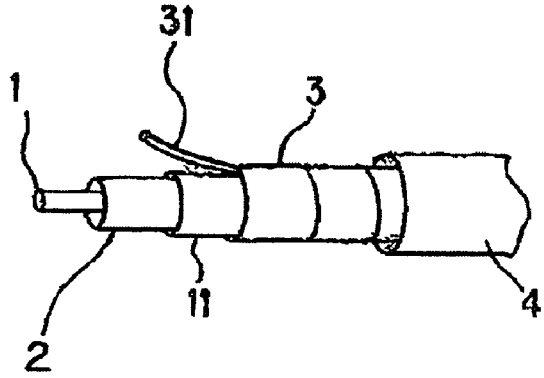
FIG. 3 shows an example of a foam coaxial cable according to the present invention wherein an outer conductor 3 is formed by winding a conductive foil.

In the present example, although a drain wire 31 is made to include on an insulating member lengthwise as shown in FIG. 2, it is preferred that the drain wire is provided on the outer periphery of a conductive foil in view of that variations in a characteristic impedance value are reduced and that shaping of an outer diameter and an outline of the outer periphery of the outer conductor is made as mentioned below.

The drain wire 31 may be either the same member as that of the inner conductor or thinner strands than those constituting the inner conductor so far as strength is ensured in case of connecting with the outer conductor and working therefor.

Furthermore, in order to reduce dispersion in characteristic impedance and to stable the characteristic impedance, it may be arranged in such that an application of the drain wire 31 is stopped, and an outer conductor may be constituted by a braid member or a spirally wound member made of conductor thin wires on the outer periphery of a product prepared by including a conductive foil lengthwise or winding the conductive foil.

In examples 2 and 3 shown in Table 1 (the outer conductor 3 is prepared by winding a conductive foil or including a conductive foil lengthwise), the drain wire 31 is included on an insulating member lengthwise.

Figure 5:
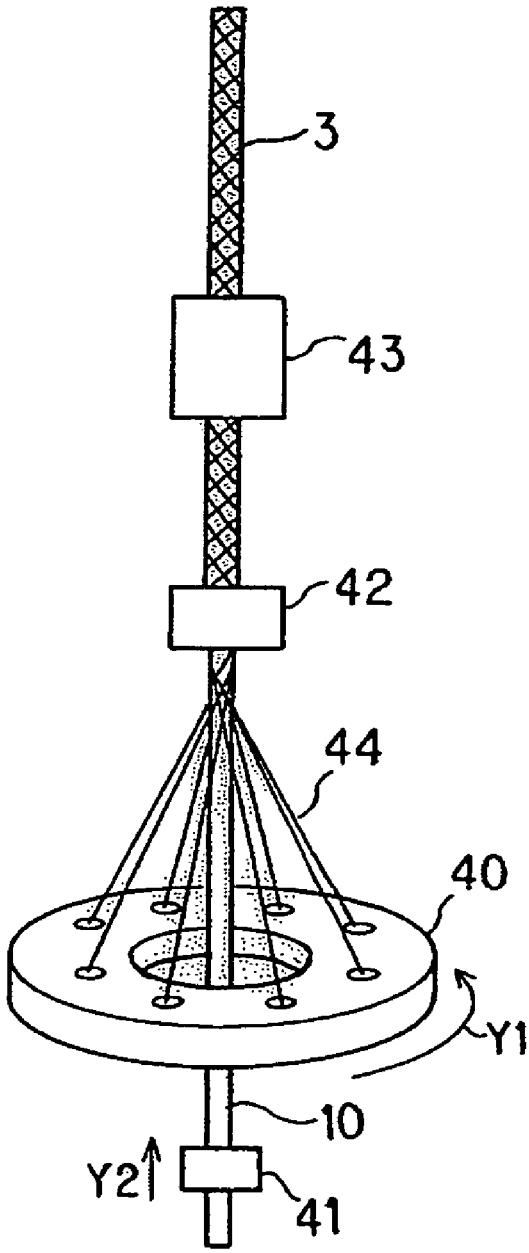
FIG. 5 is an explanatory view showing an example of a method of manufacturing a foam coaxial cable according to the present invention including a step for forming an outer conductor 3 with a braid member, and a step for shaping the outer conductor thereafter.

In the case where the outer conductor 3 is formed from a braid member, the outer conductor is braided, and then its outer diameter and outline are shaped as shown in FIG. 5.

Figure 4:
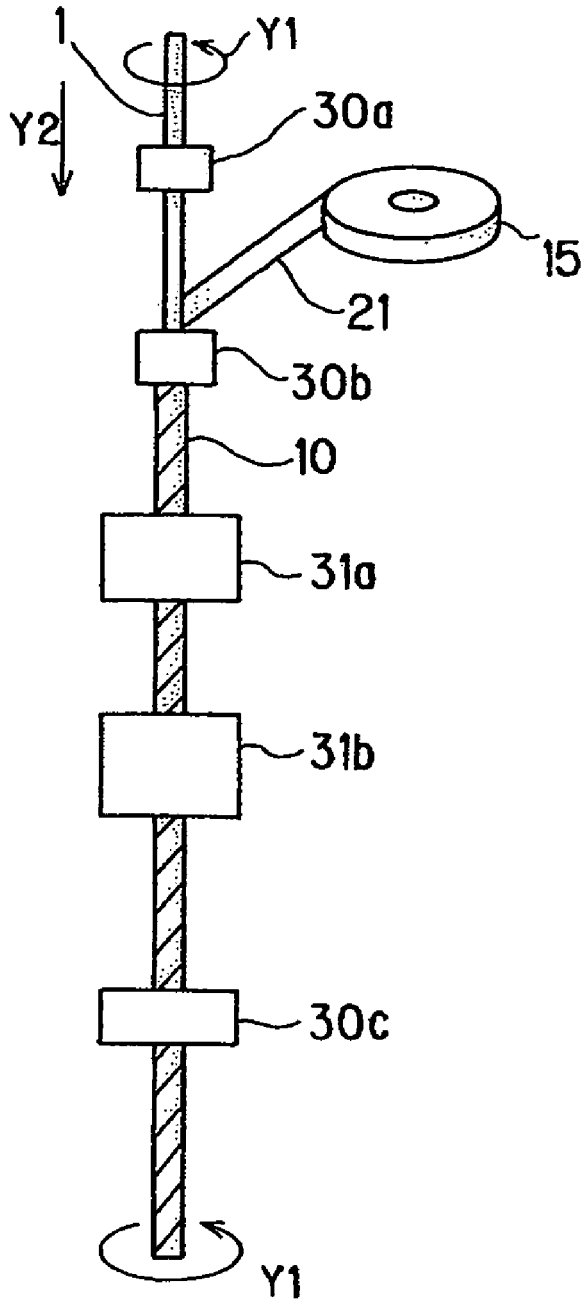
FIG. 4 is an explanatory view showing an example of a method of manufacturing a foam coaxial cable according to the present invention including a step for winding a porous tape member 21 on the outer periphery of the inner conductor 1 to form a foam insulating layer 2, and a step for shaping the foam insulating layer thereafter.

When the outer conductor 3 is formed by winding a conductive foil, a shaping method after winding a porous tape member 21 shown in FIG. 4 is similarly applied for shaping its outer diameter and its outline. In order to constitute the outer conductor 3 by winding a conductive foil, the conductive foil having a width required for winding the same is prepared, and the conductive foil is wound in ¼ or less ply. After winding the conductive foil, it is inserted into shaping dies having a predetermined inner diameter to shape its outline of the outer conductor in order to eliminate gaps produced between an insulating member and the conductive foil as a result of winding the conductive foil and to shape the conductive foil in a generally complete round. A specific example of the outer conductor 3 formed by winding a conductive foil is that of example 2 shown in Table 1, and the outer conductor is formed by winding a composite tape member having 5.5 mm tape width and composed of a copper tape having 0.01 mm thickness and a plastic tape such as PET having 0.006 mm thickness. Shaping after the winding is made by inserting the resulting outer conductor into shaping dies having 1.70 mm inner diameter and 1.5 mm length at a rate of 10 m/min.

TABLE 1

| | | Comparative Example | Example 1 | Example 2 | Example 3 |
|---|---|---|---|---|---|
| Inner Conductor | Material | Silver-Plated Soft Copper Wire | Silver-Plated Soft Copper Wire | Silver-Plated Soft Copper Wire | Silver-Plated Soft Copper Wire |

TABLE 1-continued

| | | Comparative Example | Example 1 | Example 2 | Example 3 |
|---|---|---|---|---|---|
| | Structure [Number of Wires/mm] | 7/0.16 | 7/0.16 | 7/0.16 | 7/0.16 |
| | Outer Diameter [mm] | 0.48 | 0.48 | 0.48 | 0.48 |
| Foam Insulating Layer | Material | EPTFE Tape Winding | EPTFE Tape Winding | EPTFE Tape Winding | EPTFE Tape Winding |
| | Outer Diameter [mm] | 1.15 | 0.94 | 0.94 | 0.94 |
| Skin Layer | Material | — | PFA | PFA | PFA |
| | Outer Diameter [mm] | — | 1.15 | 1.15 | 1.15 |
| Drain Wire | Material | — | — | Silver-Plated Soft Copper Wire | Silver-Plated Soft Copper Wire |
| | Structure [Number of Wires/mm] | — | — | 7/0.16 | 7/0.16 |
| Outer Conductor | Shield Type | Braid Member | Braid Member | Tape Winding | Including Tape Lengthwise |
| | Material | Ag 1.5μ, Sn0.75Cu Plated-Soft Copper | Ag 1.5μ, Sn0.75Cu Plated-Soft Copper | Copper PET Tape | Copper PET Tape |
| | Structure [mm] | 0.08 × 5N × 16C N: number of wires per carrier C: number of carriers in braid | 0.08 × 5N × 16C N: number of wires per carrier C: number of carriers in braid | Copper 0.01/ PET 0.006 | Copper 0.01/ PET 0.006 |
| | Pitch[mm] | 13 | 13 | — | — |
| | Outer Diameter [mm] | 1.50 | 1.55 | 1.70 (Major Axis) | 1.68 (Major Axis) |
| Outer Sheath | Material | FEP | FEP | FEP | FEP |
| | Thickness [mm] | 0.115 | 0.090 | 0.090 | 0.090 |
| | Outer Diameter [mm] | 1.73 (max. 1.81) | 1.73 (max. 1.81) | 1.88 (max. 1.95) (Major Axis) | 1.86 (max. 1.94) (Major Axis) |

In case of forming the outer conductor 3 by including a conductive foil lengthwise, a conductive foil having a width required for including the conductive foil lengthwise is prepared, the conductive foil is applied along an insulating member lengthwise in piles partly, and the resulting member is inserted into shaping dies having a predetermined inner diameter to shape the outer conductor. A specific example of the outer conductor 3 formed by including a conductive foil lengthwise is that shown by example 3 of Table 1, and which is formed by a composite tape member having 5.5 mm tape width and composed of a copper tape having 0.01 mm thickness and a plastic tape such as 0.006 mm thickness in the form of including the tape member lengthwise. Shaping after applying the outer conductor lengthwise, the resulting member is inserted into shaping dies having 1.68 mm inner diameter and 1.5 mm length at a rate of 40 m/min.

A secondary shaping of the outer conductor 3 in the case where the outer conductor 3 is prepared by winding a conductive foil or including the conductive foil lengthwise is made by inserting the outer conductor into shaping dies as described above, besides it is also possible to shape the outer conductor by applying ultrasonic waves to shaping dies as mentioned below.

In the following, a method of manufacturing a foam coaxial cable according to the present invention will be described.

The method of manufacturing a foam coaxial cable, comprising an insulating layer forming step for winding a porous tape member on an inner conductor supplied from a supply section to form a foam insulating layer; an insulating layer shaping step for inserting the foam insulating layer formed in the insulating layer forming step into shaping dies having a predetermined inner diameter to shape the foam insulating layer having a predetermined outer diameter and a generally complete round; a skin layer forming step for forming a skin layer having a uniform thickness and a generally complete round outline on the outer periphery of the foam insulating layer formed in the insulating layer shaping step; an outer conductor shaping step for forming an outer conductor on the outer periphery of the skin layer formed in the skin layer forming step; and an outer conductor shaping step for inserting the outer conductor formed in the outer conductor forming step into outer conductor shaping dies having a predetermined inner diameter to shape the outer conductor having a predetermined outer diameter and a generally complete round outline.

Referring to FIG. 4, the insulating layer forming step and the insulating layer shaping step will be described.

First, as shown in FIG. 4, a twisted conductor (inner conductor) 1 is supplied from a supply section (not shown) to a tape member supply section 15 and a tape winding device composed of first, second, and third guide dies 30*a*, 30*b*, and 30*c*.

The inner conductor 1 thus supplied is rotated at a predetermined number of revolutions in a direction shown by the arrow Y1. When the rotating inner conductor 1 is transferred to the direction shown by the arrow Y2 at a predetermined rate, it is wound with a porous tape member 21 having a porosity of 60% or more and supplied from the tape member supply section 15 at a position where the inner conductor passes the first guide dies 30*a* and before it reaches the second dies 30*b*. More specifically, the porous tape member 21 is arranged to be at an angle 80° and a tape tensile force of 300 g with respect to the inner conductor 1, the porous tape member is wound on the outer periphery of the inner conductor 1 in ½ ply, and further the tape member is wound once more on the outer periphery thereof.

The porous tape member 21 thus wound is passed through the second guide dies 30*b*, a tape winding member 10 formed by the passage is inserted into the first and second shaping dies 31*a* and 31*b* disposed between the second and third guide dies 30*b* and 30*c*. At the time of the insertion, the foam insulating layer 2 is shaped by means of drawing force due to inner diameters of the respective shaping dies 31*a* and 31*b* wherein the first shaping dies 31*a* have 1.13 mm inner diameter and 3.0 mm die length, while the second shaping dies have 1.12 mm inner diameter and 3.0 mm die length, and a passage time of the tape winding member 10 was 10 m/min.

An outline of the foam insulating layer 2 thus shaped becomes a generally complete round sectional cylindrical shape, so that it is in close contact with the inner conductor 1, whereby unevenness in thickness, irregularities of the outline, and dispersion in its outer diameter are reduced. In order to effect more smooth shaping of the tape winding member 10 by means of the shaping dies 31*a* and 31*b*, the shaping dies 31*a* and 31*b* or the like may be rotated at a predetermined number of revolutions. Furthermore, when winding of a tape is carried out at the same time of calcining a tape member, the shaping dies 31*a* and 31*b* may be heated at a calcination temperature. The tape winding member 10 on which the foam insulating layer 2 is formed is taken up by a take-up device (not shown).

A step for forming a skin layer will be explained by referring to FIG. 6.

First, a cable 10' prior to formation of a skin layer and which is wound with the porous tape member 21 is supplied from a supplying device A. The cable 10' prior to formation of a skin layer is inserted into shaping dies 22 before extrusion molding, whereby it is shaped to have a predetermined outer diameter and a generally complete round outline. Then, the cable 10' prior to formation of a skin layer which has been shaped to have the predetermined outer diameter and the generally complete round outline enters in extrusion dies 24 of an extrusion device 23, whereby a skin layer 11 of a predetermined outer diameter is formed. Then, the cable 10" after the skin layer formation which contains the skin layer 11 of a predetermined outer diameter is inserted into shaping dies 26 heated at a predetermined temperature to be subjected to secondary shaping. The cable 10" after the skin layer formation shaped by the shaping dies 26 is cooled in a cooling trough 27, and then it is taken up by a take-up section B.

In the above-described forming method of the skin layer 11, use conditions of the shaping dies 26, for example, when the skin layer 11 is a foam layer made of an olefin resin, an inner diameter is 1.15 mm, a heating temperature is 110 to 150° C., and a shaping rate is 40 m/min.

Furthermore, in the shaping method of the above-described skin layer 11, when variations in an outer diameter of the skin layer 11 made of a foam layer increase, it is desired that the shaping dies 26 are made to be in two-stages in response to variations, and its outer diameter is gradually shaped.

In reference to FIG. 5, a step for forming an outer conductor and a step for shaping the outer conductor will be described wherein a method for forming the outer conductor 3 by braiding a plurality of strands for braiding (corresponding to the above-described example 1) will be described hereinafter. On one hand, a method for forming the outer conductor 3 by winding a conductive film (corresponding to the above-described 2) and a method for forming the outer conductor 3 by including a conductive film lengthwise (corresponding to the above-described example 3) are those as mentioned above.

First, the tape winding member 10 formed by winding the outer periphery of the inner conductor 1 with the porous tape member 21 in the above-described step for forming an insulating member so as to have a predetermined outer diameter and a predetermined outline is supplied to a knitting and braiding device 40 wherein the tape winding member is inserted into first and second guide dies 41, 42 and shaping dies 43 of the knitting and braiding device 40.

The tape winding member 10 is guided by the first guide dies 41 which function also as shaping dies, and at the same time, the tape winding means 10 prior to braiding is shaped to have a predetermined outer diameter and a predetermined outline.

The tape winding member 10 passed through the first guide dies 41 is woven with strands 44 for braiding by rotation of the braiding device 40 which contains a plurality of the strands 44 for braiding and rotates alternately in reverse directions, and the tape winding member thus woven is braided immediately before the second guide dies 42.

After the braiding, when the braided tape winding member is inserted into the second guide dies 42 functioning also as shaping dies, an outer periphery of the braided tape winding member is formed. Moreover, when the resulting braided tape winding member is inserted into the shaping dies 43, the braided outer conductor 3 is formed wherein the shaping dies 43 have 1.5 mm inner diameter and 3.0 mm die length, and the shaping dies are rotated by a motor (not shown) at a number of revolutions being substantially ten times higher than that of a rate of braiding at only the time of operating the braiding device 40, whereby the outer conductor 3 is shaped.

Besides, since the outer conductor 3 is stretched in its longitudinal direction to be drawn at the time of shaping the outer conductor 3 by means of the shaping dies 43, it comes to be in more closely contact with the foam insulating layer 2, whereby a gap between the outer conductor 3 and the foam insulating layer 2 disappears, an inner diameter of the outer conductor 3 comes to be nearer to a value of an outer diameter of the insulating layer 2, unevenness in a thickness, irregularities in its outline and dispersion in the outer diameter of the outer conductor 3 decrease, resulting in a generally complete round sectional cylindrical shape, so that a constant characteristic impedance value is obtained and variations thereof are reduced. A cable on which the outer conductor 3 is formed is taken up by a take-up device disposed downstream (not shown).

In addition, supersonic vibration may be applied to the shaping dies 43 to give predetermined vibrations in a direction of the outer diameter of the outer conductor 3 thereby to effect formation in a step for forming an outer conductor.

Namely, when a cable obtained by braiding the outer conductor 3 to the tape winding member 10 with the strands 44 for braiding is shaped by inserting it into the shaping dies 43, supersonic vibration having, for example, a frequency of 20 to 45 kHz, 5 μm amplitude number, and an output of 200 to 700 W is applied to the shaping dies 43 by means of an ultrasonic generator thereby to shape the outer conductor 3. As the result of the shaping, the outer conductor 3 comes to be in close to the insulating layer 2 and to be integrated therewith, whereby a thickness of the outer conductor 3 becomes uniform, irregularities of its outline disappear, so that the outer conductor is shaped in a generally complete round.

Although the above-described step for shaping the outer conductor is arranged after a step for forming the outer conductor, either it may be arranged alone immediately before a step for forming an outer cover, or it may be arranged both after the step for forming the outer conductor and immediately before the step for forming the outer cover.

When the step for forming an outer cover is implemented after carrying out the insulating forming/shaping steps, and a skin layer forming step and outer conductor forming/shaping steps as mentioned above, a foam coaxial cable wherein the inner conductor 1 is sequentially covered with the foam insulating layer 2, the skin layer 11, the outer conductor 3, and the outer cover 4 is formed as shown in FIG. 1.

Table 2 shows results obtained by measuring accuracy in characteristic impedance of the foam coaxial cables of examples 1 to 3 wherein the skin layer 11 is formed on the above-described foam insulating layer 2 to constitute an insulating layer, and accuracy in characteristic impedance of a foam coaxial cable of a comparative example wherein no skin layer is formed.

TABLE 2

| | | Comparative Example | Example 1 | Example 2 | Example 3 |
|---|---|---|---|---|---|
| Z0 (Ω) | Mean Value | 50.98 | 51.04 | 51.12 | 51.15 |
| | Maximum Value | 51.7 | 51.6 | 51.8 | 51.8 |
| | Minimum Value | 50.3 | 50.5 | 50.3 | 50.5 |
| | Maximum Width | 1.4 | 1.1 | 1.5 | 1.3 |
| | Standard Deviation | 0.229 | 0.21 | 0.24 | 0.246 |

It is to be noted that the respective detailed constitutions of examples 1 to 3 and the comparative example are shown in the Table 1 wherein characteristic impedance values are measured in accordance with a TDR method.

As a result, it is found that all the characteristic impedance values are within a range of 51.0±1 Ω as to the foam coaxial cables of examples 1 to 3 wherein an insulating layer is constituted by forming the skin layer 11 on the foam insulating layer 2, whereby accuracy in characteristic impedance values between the inner conductor and the outer conductor is within a range of ±1 Ω.

Accordingly, it is confirmed that the accuracy in characteristic impedances in the foam coaxial cables of examples 1 to 3 according to the present invention wherein the insulating layer is constituted by forming the skin layer 11 on the foam insulating layer 2 is remarkably improved.

According to the foam coaxial cable of the present invention, the foam coaxial cable is composed of an inner conductor, a foam insulating layer formed on the outer periphery of the inner conductor, an outer conductor formed on the outer periphery of the foam insulating layer, and an outer cover formed on the outer periphery of the outer conductor wherein a skin layer having a generally complete round outline is formed on the outer circumference of the foam insulating layer. Thus, the foam coaxial cable of the invention can make a transmission rate speeding up, can improve accuracy of the characteristic impedance value, and can make flexibility of the cable better, so that even if the cable receives mechanical stresses such as flexure, torsion, pressing, and sliding, the foam coaxial cable assures a predetermined mechanical strength by decreasing the stresses, and can reduce variations in characteristic impedance values.

According to the method of manufacturing a foam coaxial cable of the invention, the method including an inner conductor, a foam insulating layer formed on the outer periphery of the inner conductor, and an outer conductor formed on the outer periphery of the foam insulating layer, comprises an insulative layer forming step for winding a porous tape member on the inner conductor supplied from a supply section to form the foam insulating layer; an insulating layer shaping step for inserting the foam insulating layer formed in the insulating layer forming step into shaping dies having a predetermined inner diameter to shape the foam insulating layer so as to have a predetermined outer diameter and a generally complete round outline; a skin layer forming step for forming a skin layer having a uniform thickness and a generally complete round shape on the outer periphery of the foam insulating member shaped in the insulating layer shaping step; an outer conductor forming step for forming the outer conductor on the outer periphery of the skin layer formed in the skin layer forming step; and an outer conductor shaping step for inserting the outer conductor formed in the outer conductor forming step into shaping dies having a predetermined inner diameter so as to have a predetermined outer diameter and a generally complete round outline. Thus, thicknesses and outer diameters of the foam insulating layer and the outer conductor are uniformized, and further the outline thereof is made to be a generally complete round, so that improvement in accuracy of characteristic impedance values between the inner conductor and the outer conductor can be intended, whereby a secondary shaping step can be stabilized.

The invention claimed is:

1. A foam coaxial cable composed of an inner conductor, a foam insulating layer formed on the outer periphery of the inner conductor, and an outer conductor formed on the outer periphery of the foam insulating layer, characterized by that a skin layer having a generally complete round outline and outer diameter accuracy of ±0.02 mm is formed on the outer periphery of the foam insulating layer; and accuracy of characteristic impedance values between the inner conductor and the outer conductor in which the foam insulating layer and the skin layer are interposed between them is ±1 Ω.

2. The foam coaxial cable as claimed in claim 1, wherein the inner conductor has outer diameter accuracy of 2/1000 mm or less and the inner conductor is constituted by twisting silver-plated soft copper wires each containing silver-plating having a thickness of 1 to 3 μm.

3. The foam coaxial cable as claimed in claim 2, wherein the porous tape member is a calcined PTFE tape member having a compressive deformation strain of 0.6 to 0.8% in the case where the porous tape member has a porosity of 60% or more, porous accuracy of ±5%, a tolerance of thickness of ±3 μm, and a compression stress of 0.24 to 0.28 kg weight.

4. The foam coaxial cable as claimed in claim 1, wherein the skin layer is composed of a foam material prepared from a polyolefin resin or a fluorine resin and having a forming ratio of 50% or less.

5. The foam coaxial cable as claimed in claim 1, wherein the skin layer is composed of an extruded solid material prepared from a polyolefin resin or a fluorine resin.

6. The foam coaxial cable as claimed in claim 1, wherein the outer conductor is formed by either winding a conductive metallic foil or a composite tape member composed of the conductive metallic foil and a plastic layer, or including a conductive metallic foil or a composite tape member composed of the conductive metallic foil and a plastic layer lengthwise, and the outer conductor has a generally complete round outline and outer diameter accuracy of ±0.02 mm.

7. The foam coaxial cable as claimed in claim 1, wherein the outer conductor is formed by braiding a number of conductive thin wires, and the outer conductor has a generally complete round outline and outer diameter accuracy of ±2%.

8. The foam coaxial cable as claimed in claim 1, wherein the outer conductor is constituted by a braid member of two-layer plated soft copper wires each of which is prepared by applying a tin alloy plating having a thickness of 0.2 to 0.5 m to a silver-plated soft copper wire having a thickness of 1 to 3 μm to have an outer diameter tolerance of 2/1000 mm.

9. The foam coaxial cable as claimed in claim 8, wherein the tin alloy plating consists of tin and copper, and a ratio of content of copper is in 0.6 to 2.5%.

10. The foam coaxial cable as claimed in claim 1, wherein the outer conductor is constituted by a braid member of two-layer plated soft copper wires each of which is prepared by applying a tin alloy plating having a thickness of 0.2 to 0.5 μm to a nickel-plated soft copper wire having a thickness of 1 to 3 μm to have an outer diameter tolerance of ±2/1000 mm.

11. A foam coaxial cable composed of an inner conductor, a foam insulating layer formed on the outer periphery of the inner conductor, and an outer conductor formed on the outer periphery of the foam insulating layer, characterized by that:

the inner conductor has outer diameter accuracy of 4/1000 mm or less;

the foam insulating layer is formed with winding a porous tape member, and it has a generally complete round outline and outer diameter accuracy of 0.02 mm after forming the foam insulating layer;

a skin layer having a generally complete round outline and outer diameter accuracy of ±0.02 mm is formed on the outer periphery of the foam insulating layer; and accuracy of characteristic impedance values between the inner conductor and the outer conductor in which the foam insulating layer and the skin layer are interposed between them is ±1 Ω.

12. The foam coaxial cable as claimed in claim 11, wherein the foam insulating layer is constituted by winding the porous tape member on the periphery of the inner conductor in 1/2-ply, variations in the thickness and the outer diameter of the insulating member after winding are ±0.01 mm and 0.02 mm, respectively, and the insulating member is formed into a generally complete round shape.

13. The foam coaxial cable as claimed in claim 11, wherein the foam insulating layer is constituted by winding the porous tape member on the periphery of the inner conductor with no ply.

14. The foam coaxial cable as claimed in claim 11, wherein the porous tape member is a calcined PTFE tape member having a compressive deformation strain of 0.6 to 0.8% in the case where the porous tape member has a porosity of 60% or more, porous accuracy of ±5%, a tolerance of thickness of ±3 μm, and a compression stress of 0.24 to 0.28 kg weight.

15. The foam coaxial cable as claimed in claim 11, wherein the inner conductor has outer diameter accuracy of 2/1000 mm or less and the inner conductor is constituted by twisting silver-plated soft copper wires each containing silver-plating having a thickness of 1 to 3 μm.

16. The foam coaxial cable as claimed in claim 11, wherein the skin layer is composed of a foam material prepared from a polyolefin resin or a fluorine resin and having a forming ratio of 50% or less.

17. The foam coaxial cable as claimed in claim 11, wherein the skin layer is composed of an extruded solid material prepared from a polyolefin resin or a fluorine resin.

18. A method of manufacturing a foam coaxial cable involving an inner conductor, a foam insulating layer formed on the outer periphery of the inner conductor, and an outer conductor formed on the outer periphery of the foam insulating layer, characterized by including:

an insulative layer forming step for winding a porous tape member on the inner conductor supplied from a supply section to form the foam insulating layer;

an insulating layer shaping step for inserting the foam insulating layer formed in the insulating layer forming step into shaping dies having a predetermined inner diameter to shape the foam insulating layer so as to have a predetermined outer diameter and a generally complete round outline;

a skin layer forming step for forming a skin layer having a uniform thickness and a generally complete round. shape on the outer periphery of the foam insulating member shaped in the insulating layer shaping step;

an outer conductor forming step for forming the outer conductor by means of braiding a plurality of conductive thin wires on the outer periphery of the skin layer formed in the skin layer forming step; and an outer conductor shaping step for inserting the outer conductor formed in the outer conductor forming step into shaping dies having a predetermined inner diameter so as to have a predetermined outer diameter and a generally complete round outline;

whereby accuracy of characteristic impedance values between the inner conductor and the outer conductor in which the foam insulating layer and the skin layer are interposed between them is made to be ±1 Ω.

19. The method of manufacturing a foam coaxial cable as claimed in claim 18, wherein the skin layer forming step includes a step for forming a foam skin layer having a foaming ratio of 50% or less as a result of extrusion molding, and a skin layer secondary shaping step for inserting the formed foam skin layer into shaping dies having a predetermined inner diameter so as to have a predetermined outer diameter and a generally complete round outline.

20. The method of manufacturing a foam coaxial cable as claimed in claim 18, wherein the outer conductor forming step is a step for forming the outer conductor by either winding a conductive metallic foil or a composite tape member composed of the conductive metallic foil and a plastic layer on the periphery of the skin layer, or including a conductive metallic foil or a composite tape member composed of the conductive metallic foil and a plastic layer lengthwise on the periphery of the skin layer in place of braiding a plurality of conductive thin wires.

* * * * *

UNITED STATES PATENT AND TRADEMARK OFFICE

CERTIFICATE OF CORRECTION

PATENT NO. : 7,355,123 B2
APPLICATION NO. : 10/557715
DATED : April 8, 2008
INVENTOR(S) : Hiroyuki Kimura et al.

It is certified that error appears in the above-identified patent and that said Letters Patent is hereby corrected as shown below:

Claim 2
on column 14, line 61, change “2/1000” to -- ±2/1000 --

Claim 8
on column 15, line 30, change “0.5 m” to -- 0.5 μm -- on column 15, line 31, change “2/1000” to -- ±2/1000 --

Claim 11
on column 15, line 52, change “0.02 mm” to -- ± 0.02 mm --

Claim 12
on column 15, line 66, change “0.02 mm” to -- ± 0.02 mm --

Claim 18
on column 16, lines 39-40, change “complete round. shape” to -- complete round shape --

Signed and Sealed this

Twenty-sixth Day of August, 2008

JON W. DUDAS
*Director of the United States Patent and Trademark Office*